US009913043B2

(12) United States Patent
Song et al.

(10) Patent No.: US 9,913,043 B2
(45) Date of Patent: Mar. 6, 2018

(54) LOUDSPEAKER VIBRATION SYSTEM

(71) Applicant: GOERTEK INC., Weifang (CN)

(72) Inventors: Qianqian Song, Weifang (CN); Chao Jiang, Weifang (CN)

(73) Assignee: Goertek Inc., Weifang, Shandong Province (CN)

( * ) Notice: Subject to any disclaimer, the term of this patent is extended or adjusted under 35 U.S.C. 154(b) by 0 days.

(21) Appl. No.: 15/254,789

(22) Filed: Sep. 1, 2016

(65) Prior Publication Data

US 2016/0373863 A1 Dec. 22, 2016

Related U.S. Application Data

(63) Continuation of application No. PCT/CN2015/073628, filed on Mar. 4, 2015.

(30) Foreign Application Priority Data

Mar. 5, 2014 (CN) ..... 2014 1 0078705

(51) Int. Cl.
*H04R 1/00* (2006.01)
*H04R 9/06* (2006.01)
(Continued)

(52) U.S. Cl.
CPC ..... *H04R 9/06* (2013.01); *H04R 7/04* (2013.01); *H04R 7/20* (2013.01); *H04R 31/003* (2013.01); *H04R 2307/025* (2013.01)

(58) Field of Classification Search
CPC ... H04R 9/06; H04R 7/04; H04R 7/20; H04R 31/003; H04R 2307/025
(Continued)

(56) References Cited

U.S. PATENT DOCUMENTS

2009/0046889 A1* 2/2009 Huang ..... H04R 9/00 381/433
2012/0148073 A1* 6/2012 Kim ..... H04R 17/005 381/190
(Continued)

FOREIGN PATENT DOCUMENTS

CN 201294626 Y 8/2009
CN 102474684 A 5/2012
(Continued)

OTHER PUBLICATIONS

International Search Report (including English translation) dated May 27, 2015, issued in International Application No. PCT/CN2015/073628. (6 pages).

*Primary Examiner* — Sean H Nguyen

(57) ABSTRACT

A loudspeaker vibration system includes a diaphragm body part and a voice coil engaged at a lower side of the diaphragm body part. The diaphragm body part includes a rigid dome part, a silicon rubber membrane, and a plastic support engaged to an edge of the silicon rubber membrane. The dome part is engaged at a middle position of the silicon rubber membrane. A convex or concave bent ring part is provided at a location at an outer side of the dome part on the silicon rubber membrane. A spacing between the edge at an outer side of the dome part and an edge of the bent ring part closer to the dome part is in a range of 0.02 mm and 0.2 mm, and colloid is disposed in a gap between the dome part and the bent ring part. The loudspeaker vibration system according to the present disclosure may improve product sensitivity, reduce distortion and enhance acoustic performance of the product.

12 Claims, 2 Drawing Sheets

(51) Int. Cl.

| | |
|---|---|
| ***H04R 11/02*** | (2006.01) |
| ***H04R 7/04*** | (2006.01) |
| ***H04R 7/20*** | (2006.01) |
| ***H04R 31/00*** | (2006.01) |

(58) Field of Classification Search
USPC ..... 381/398
See application file for complete search history.

(56) References Cited

U.S. PATENT DOCUMENTS

| | | | | |
|---|---|---|---|---|
| 2012/0160597 | A1* | 6/2012 | Li | H04R 7/04 181/157 |
| 2014/0355816 | A1* | 12/2014 | Jeong | H04R 1/00 381/433 |

FOREIGN PATENT DOCUMENTS

| | | | |
|---|---|---|---|
| CN | 103052017 | A | 4/2013 |
| CN | 103109547 | A | 5/2013 |
| CN | 202931542 | U | 5/2013 |
| CN | 103856874 | A | 6/2014 |
| CN | 203748002 | U | 7/2014 |
| JP | 2009296160 | A | 12/2009 |
| WO | 2009104263 | A1 | 8/2009 |

* cited by examiner

LOUDSPEAKER VIBRATION SYSTEM

CROSS REFERENCE TO RELATED APPLICATIONS

This application is a continuation of International Application No. PCT/CN2015/073628, filed on Mar. 4, 2015, which is based upon and claims priority to Chinese Patent Application No. 201410078705.5, filed on Mar. 5, 2014, the entire contents of which are incorporated herein by reference.

FIELD OF THE DISCLOSURE

The present disclosure relates to the technical field of electroacoustic products, and particularly to a loudspeaker vibration system.

BACKGROUND OF THE DISCLOSURE

A diaphragm in a conventional loudspeaker vibration system usually employs a structure formed by bonding multiple resin material layers, but such structure of diaphragm formed by bonding multiple layers of material is apt to cause non-uniformity of thickness of the diaphragm so that the uniformity of the diaphragm is undesirable. As an improvement, the material of the diaphragm may be changed into silicon rubber membrane. A layer of silicon rubber membrane can satisfy needs of the product, so the diaphragm made from such material exhibits good uniformity. During practical application, a rigid dome part is usually disposed on the silicon rubber membrane to improve an acoustic performance of the loudspeaker. However, the diaphragm of the silicon rubber material is softer and more compliant than the diaphragm made of multiple layers of resin materials, and furthermore, transition of combination of the silicon rubber membrane and the rigid dome part is undesirable, thus it is apt to cause distortion and sensitivity is rather low. Therefore, it is necessary to improve the diaphragm made of such silicon rubber material to enhance the performance of the diaphragm of such material, reduce distortion of the diaphragm, and boost its sensitivity.

SUMMARY OF THE DISCLOSURE

A technical problem to be solved by the present disclosure is to provide a loudspeaker vibration system to improve product sensitivity, reduce distortion and boost the acoustic performance of the product.

To solve the above technical problem, the present disclosure employs the following technical solutions: a loudspeaker vibration system, comprising a diaphragm body part and a voice coil engaged at a lower side of the diaphragm body part; the diaphragm body part comprises a rigid dome part, a silicon rubber membrane and a plastic support engaged to an edge of the silicon rubber membrane; the dome part is engaged at a middle position of the silicon rubber membrane, a convex or concave bent ring part is provided at a location at an outer side of the dome part on the silicon rubber membrane, wherein a spacing between the edge at an outer side of the dome part and an edge of the bent ring part closer to the dome part is configured in a range of numerical value between 0.02 mm and 0.2 mm, and colloid is disposed in a gap between the dome part and the bent ring part.

The above description only generalizes technical solutions of the present disclosure. The present disclosure may be implemented according to the content of the description in order to make technical means of the present disclosure more apparent. Specific embodiments of the present disclosure are exemplified to make the above and other objects, features and advantages of the present disclosure more apparent.

BRIEF DESCRIPTION OF DRAWINGS

The present disclosure will be described below with reference to figures, and the above features and technical advantages of the present disclosure will be made more apparent and comprehensible.

DETAILED DESCRIPTION

Figure 1:
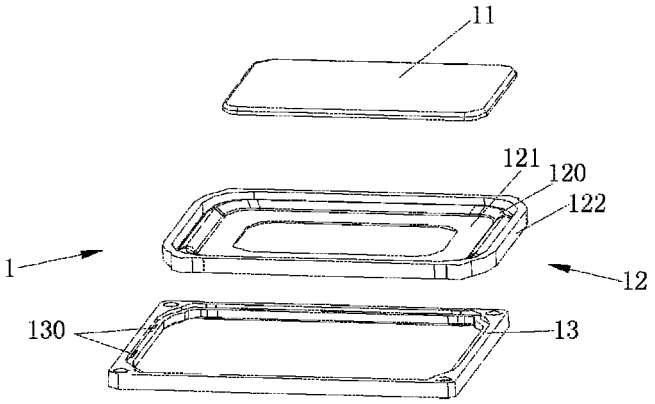
FIG. 1 is a 3D exploded view of a diaphragm body part according to the present disclosure.
Figure 2:
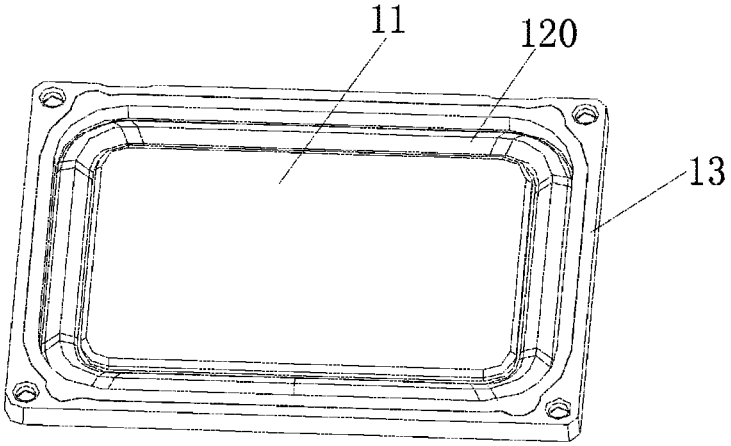
FIG. 2 is a 3D structural schematic view of the diaphragm body part according to the present disclosure.

The present disclosure will be described in detail in conjunction with figures and specific embodiments.

In the description hereunder, some exemplary embodiments of the present disclosure are described only in illustration manner. Undoubtedly, those skilled in the art can appreciate that the embodiments may be modified in various different manners without departing from the spirit and scope of the present disclosure. Hence, the figures and depictions are in essence descriptive and not intended to limit the protection scope of claims. In the description, identical reference signs denote identical or similar parts.

The loudspeaker vibration system according to the present disclosure comprises a diaphragm body part and a voice coil engaged at a lower side of the diaphragm body part; the diaphragm body part comprises a plastic support and a silicon rubber membrane engaged with the plastic support by injection molding, the silicon rubber membrane is formed as a bent ring part, a rigid planar dome part is engaged on inside of the bent ring part, and the rigid dome part may enhance high-frequency acoustic effect of the diaphragm. Since the silicon rubber material is rather soft and exhibits rather large elasticity and compliance, in the present disclosure a spacing between the edge at an outer side of the dome part and an edge of the bent ring part closer to the dome part is configured in a range of numerical value between 0.02 mm and 0.2 mm, and colloid is disposed in a gap between the dome part and the bent ring part, which assists in improving acoustic performance of the product, reducing distortion and improving sensitivity.

Additionally or alternatively, the silicon rubber membrane is engaged with the plastic support by injection molding; a side of the plastic support adjacent to the silicon rubber membrane is provided with through holes vertically running through the plastic support, and the silicon rubber membrane material is filled in the through holes.

Additionally or alternatively, the silicon rubber membrane comprises a engagement part located at a central position and engaged with the dome part, a connection part engaged with the plastic support by injection molding, and a bent ring part located between the engagement part and the connection part.

Additionally or alternatively, the spacing between the edge at an outer side of the dome part and an edge of the bent ring part closer to the dome part is 0.1 mm.

Additionally or alternatively, the silicon rubber membrane is an annular structure with material at the center being cut away.

Additionally or alternatively, the silicon rubber membrane is a liquid-state silicon rubber membrane.

Additionally or alternatively, the dome part is engaged at an upper side and/or underside of the silicon rubber membrane.

As compared with conventional structures, the spacing between the dome part and the bent ring part in the loudspeaker vibration system in the present disclosure employing the above technical solutions is in a range of numerical value between 0.02 mm and 0.2 mm, thereby shortening the distance between the dome part and the bent ring part, and effectively increasing the area of the dome part. Furthermore, colloid is disposed in the gap between the dome part and the bent ring part, thereby enabling excellent transition between the dome part and the silicon rubber membrane, and thereby reducing product distortion, improving product sensitivity and enhancing acoustic performance of the product. Meanwhile, during practical application of the loudspeaker system of the present disclosure, since an area of the dome part is increased, acoustic radiation area may be increased, and acoustic performance of the loudspeaker is improved. Furthermore, increase of the area of the dome part may increase the voice coil and the magnetic circuit system of the loudspeaker without increasing the overall size of the loudspeaker, and thereby improve the acoustic performance of the loudspeaker.

As shown in FIG. 1 through FIG. 5, the loudspeaker vibration system comprises a diaphragm body part 1 and a voice coil 2 engaged at a lower side of the diaphragm body part 1. The voice coil 2, after being communicated with an electrical signal, vibrates up and down in a magnetic gap formed by a magnetic circuit system (not shown in the figures), and then brings the diaphragm body part 1 into vibration to produce sound. Wherein, the diaphragm body part 1 comprises a dome part 11, a silicon rubber membrane 12 and a plastic support 13 which are engaged in turn; the dome part 11 is a rigid structure engaged to a central position of the silicon rubber membrane 12, and the silicon rubber membrane 12 and plastic support 13 are integrally secured to each other by injection molding.

Figure 3:
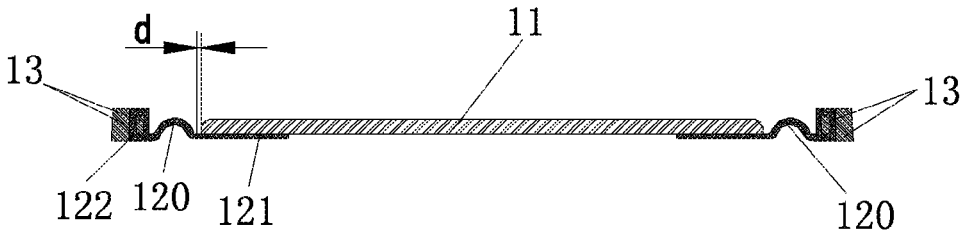
FIG. 3 is a sectional view of the diaphragm body part according to the present disclosure.
Figure 5:
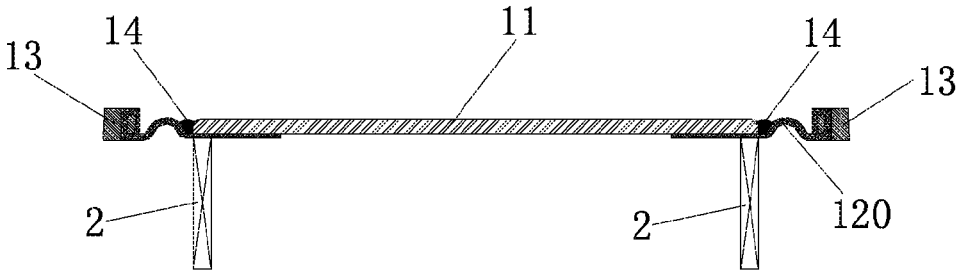
FIG. 5 is a sectional view of a loudspeaker vibration system according to the present disclosure.

In the present embodiment, the silicon rubber membrane 12 is injection molded from a silicon rubber material into an injection-molded structure. Preferably, the silicon rubber material is a liquid-state silicon rubber. Since the liquid-state silicon rubber has advantages such as nice mobility, quick vulcanization speed and easy injection molding, it is more adapted for injection molding. Preferably, while the silicon rubber membrane 12 is injection molded, it is engaged with the plastic support 13 into a unitary structure by injection molding. A side of the plastic support 13 adjacent to the silicon rubber membrane 12 is provided with through holes 130 running through an upper surface and a lower surface of the plastic support 13. While the silicon rubber membrane 12 and plastic support 13 are injection-molded and formed, silicon rubber material is filled in the through holes 130, as shown in FIG. 3 and FIG. 5. Such configuration enables a part of the silicon rubber membrane 12 to be embedded into the plastic support 13 so that the silicon rubber membrane 12 and plastic support 13 are engaged into one piece more firmly to prevent the silicon rubber membrane 12 from disengaging from the plastic support.

The silicon rubber membrane 12 is a single-layer diaphragm structure and can ensure uniformity of the diaphragm. The silicon rubber membrane 12 comprises a planar engagement part 121 located at a central position, a connection part 122 located at an edge position and injection-molded with the plastic support 13, and a bent ring part 120 located between the engagement part 121 and the connection part 122, as jointly shown in FIG. 1 and FIG. 3. The bent ring part 120 is an upwardly convex or downwardly concave structure and may enable the diaphragm body part 1 to vibrate up and down due to action of the voice coil 2. In the present embodiment, the bent ring part 120 is a convex structure, but not limited to such structure. The dome part 11 is a planar structure and engaged to an upper surface of the engagement part 121 at the center of the silicon rubber membrane 12. In the present embodiment, the dome part 11 and the engagement part 121 are secured to each other into one piece by adhesion. Since the dome part 11 exhibits a rather large rigidity, it may prevent the diaphragm body part 1 from generating split vibration at high frequency bands and facilitate enhancement of the high frequency acoustic effect of the diaphragm body part 1. In addition, the dome part 11 may be engaged at an upper side and/or underside of the silicon rubber membrane 12, and not limited to such structure of the present embodiment. Besides, to reduce the weight of the diaphragm body part 1 and improve sensitivity of the product, in the present embodiment the central position of the engagement part 121 is cut to make the silicon rubber membrane 12 a hollow annular structure, thereby reducing the weight of the cut-away material and facilitating improvement of the sensitivity of the product.

Since the silicon rubber membrane 12 is rather soft and exhibits rather large elasticity and compliance, compliance needed by the diaphragm body part 1 in vibration can be satisfied in the case that the bent ring part 120 is rather narrow. As such, a region at the central part of the silicon rubber membrane 12 may be enlarged, i.e., an area of the dome part 11 may be increased, and furthermore, an effective vibration area of the diaphragm body part 1 may be increased and the product sensitivity be improved. Additionally, since the voice coil 2 is usually engaged at the edge at an outer side of the dome part 11 as shown in FIG. 3 and FIG. 5. Such rather narrow structure of the voice coil 2 may also increase an inner diameter of the voice coil 2, enlarge the magnetic circuit system, improve the product sensitivity, reduce distortion of the product and enhance the acoustic performance of the loudspeaker.

In addition, in the present embodiment, the spacing d between the dome part 11 and the bent ring part 120 is rather small as shown in FIG. 3. Preferably, the spacing d is in a range of numerical value between 0.02 mm and 0.2 mm, wherein the spacing d is a distance between the edge at an outer side of the dome part 11 and an edge of the bent ring part 120 closer to the dome part 11, and wherein the edge of the bent ring part 120 closer to the dome part 11 refers to a chamfered termination at a location where the bent ring part 120 is connected with the engagement part 121. Such configuration with a rather small spacing between the dome part 11 and bent ring part 120 may maximize the area of the dome part 11, thereby assisting in improving the effective vibration area of the diaphragm, increasing acoustic radiation area, and meanwhile increasing the size of the voice coil 2 and the magnetic circuit system, improving product sensitivity, reducing product distortion and enhancing acoustic performance of the product.

Preferably, the spacing d is 0.1 mm. When d is 0.1 mm, the diaphragm body part 1 exhibits an optimal performance and excellent sensitivity and acoustic performance.

Figure 4:
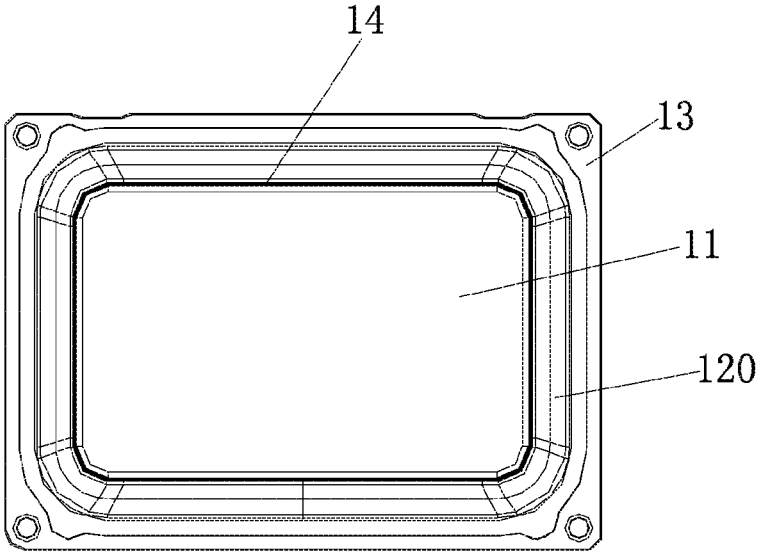
FIG. 4 is a dome view of the diaphragm body part with a damping colloid being applied according to the present disclosure.

Preferably, colloid 14 is disposed in the gap between the dome part 11 and the bent ring part 120 in the present embodiment, as shown in FIG. 4 and FIG. 5. The duly applied colloid 14 may increase a damping property of the diaphragm body part 1, improve transition between the bent ring part 120 and the dome part 11 and thereby reduce product distortion.

To conclude, the spacing between the dome part 11 and the bent ring part 120 of the present disclosure is in a range of numerical value between 0.02 mm and 0.2 mm, thereby shortening the distance between the dome part 11 and the bent ring part 120, increasing the size of the dome part 11, and thereby improving product sensitivity and enhancing the overall acoustic performance of the product; in addition, the damping colloid 14 is disposed in the gap between the dome part 11 and the bent ring part 120, and such structure with the damping colloid 14 being applied may increase the damping of the diaphragm body part 1 and reduce the product distortion.

Under the teaching of the present disclosure, those skilled in the art may perform other improvements and variations on the basis of the above embodiments. The improvements and variations all fall within the protection scope of the present disclosure. Those skilled in the art should appreciate that the above detailed depictions are only intended to better illustrate the objective of the present disclosure, and the protection scope of the present disclosure is defined by the appended claims and equivalents thereof.

What is claimed is:

1. A loudspeaker vibration system, comprising a diaphragm body part and a voice coil engaged at a lower side of the diaphragm body part;

the diaphragm body part comprises a dome part, a silicon rubber membrane, and a plastic support engaged to an edge of the silicon rubber membrane; the dome part is engaged at a middle position of the silicon rubber membrane, a convex or concave bent ring part is provided at a location at an outer side of the dome part on the silicon rubber membrane, wherein a spacing between the edge at an outer side of the dome part and an edge of the bent ring part closer to the dome part is in a range between 0.02 mm and 0.2 mm, and colloid is disposed in a gap between the dome part and the bent ring part, wherein the silicon rubber membrane comprises an engagement part located at a central position and engaged with the dome part, a connection part engaged with the plastic support by injection molding, and a bent ring part located between the engagement part and the connection part.

2. The loudspeaker vibration system according to claim 1, wherein the silicon rubber membrane is engaged with the plastic support by injection molding; a side of the plastic support adjacent to the silicon rubber membrane is provided with through holes vertically running through the plastic support, and the silicon rubber membrane material is filled in the through holes.

3. The loudspeaker vibration system according to claim 1, wherein the spacing between the edge at an outer side of the dome part and an edge of the bent ring part closer to the dome part is 0.1 mm.

4. The loudspeaker vibration system according to claim 1, wherein the silicon rubber membrane is an annular structure with material at the center being cut away.

5. The loudspeaker vibration system according to claim 1, wherein the silicon rubber membrane is a liquid-state silicon rubber membrane.

6. The loudspeaker vibration system according to claim 1, wherein the dome part is engaged at an upper side and/or underside of the silicon rubber membrane.

7. A loudspeaker vibration system, comprising a diaphragm body part and a voice coil engaged at a lower side of the diaphragm body part;

the diaphragm body part comprises a dome part, a silicon rubber membrane, and a plastic support engaged to an edge of the silicon rubber membrane; the dome part is engaged at a middle position of the silicon rubber membrane, a convex or concave bent ring part is provided at a location at an outer side of the dome part on the silicon rubber membrane, wherein a spacing between the edge at an outer side of the dome part and an edge of the bent ring part closer to the dome part, and colloid is disposed in a gap between the dome part and the bent ring part, wherein the silicon rubber membrane comprises an engagement part located at a central position and engaged with the dome part, a connection part engaged with the plastic support by injection molding, and a bent ring part located between the engagement part and the connection part.

8. The loudspeaker vibration system according to claim 7, wherein the silicon rubber membrane is engaged with the plastic support by injection molding; a side of the plastic support adjacent to the silicon rubber membrane is provided with through holes vertically running through the plastic support, and the silicon rubber membrane material is filled in the through holes.

9. The loudspeaker vibration system according to claim 7, wherein the spacing between the edge at the outer side of the dome part and an edge of the bent ring part closer to the dome part is 0.1 mm.

10. The loudspeaker vibration system according to claim 7, wherein the silicon rubber membrane is an annular structure with material at the center being cut away.

11. The loudspeaker vibration system according to claim 7, wherein the silicon rubber membrane is a liquid-state silicon rubber membrane.

12. The loudspeaker vibration system according to claim 7, wherein the dome part is engaged at an upper side and/or underside of the silicon rubber membrane.

* * * * *